United States Patent [19]

Goldman et al.

[11] Patent Number: 4,781,800

[45] Date of Patent: Nov. 1, 1988

[54] DEPOSITION OF METAL OR ALLOY FILM

[75] Inventors: Lee M. Goldman, Arlington; Wataru Ohashi; Frans A. Spaepen, both of Lexington, all of Mass.

[73] Assignee: President and Fellows of Harvard College, Cambridge, Mass.

[21] Appl. No.: 102,106

[22] Filed: Sep. 29, 1987

[51] Int. Cl.[4] ..... C25D 5/02; C25D 17/00

[52] U.S. Cl. ..... 204/15; 204/206; 204/224 R

[58] Field of Search ..... 204/15, 206, 224 R

[56] References Cited

U.S. PATENT DOCUMENTS 3,573,176 3/1971 Laznovsky ..... 204/15
4,119,516 10/1978 Yamaguchi ..... 204/224 R
4,222,834 9/1980 Bacon et al. ..... 204/224 R
4,323,604 4/1982 Fukuda et al. ..... 204/15

FOREIGN PATENT DOCUMENTS 2118537 11/1972 Fed. Rep. of Germany ..... 204/15

OTHER PUBLICATIONS

Goldman et al., J. Appl. Phys., vol. 60(4), pp. 1374–1376.

*Primary Examiner*—T. M. Tufariello

[57] ABSTRACT

Method and apparatus for plating metal or metal alloy on a well-defined area of the surface of an article by forming a liquid plating bath having its surface maintained slightly above the rim of a container by surface tension and passing the surface to be plated in contact with the surface of the bath and spaced from the rim of the container.

12 Claims, 4 Drawing Sheets

DEPOSITION OF METAL OR ALLOY FILM

This invention was made with U.S. Government support and the Government has certain rights in the invention.

This invention relates to plating or deposition of metal or metal alloy films on a solid surface and pertains more specifically to electroplating and to electroless plating by precipitation as well as to liquid phase epitaxy. It is of particular value in making very thin electro deposits as well as multilayer deposits in that it makes possible accurate control of the margins of the deposition without the need for masking and also makes it possible to control the uniformity of thickness of very thin deposits, of the order of 10 Angstroms or less in thickness.

It has previously been proposed in German OLS No. 2,118,537 to plate the surface of an article by bringing it into contact with the surface of an electrolytic bath, the contact being maintained by surface tension; however, in this procedure the entire lower surface of the article is plated and there is no provision for plating only a restricted portion of the surface.

It has also been proposed in Fukuda et al. U.S. Pat. No. 4,323,604 to plate one side of a steel strip continuously by passing it horizontally over a plating bath while spouting the bath onto its lower side, but the entire lower surface of the article is plated and there is no provision for plating only a restricted portion of the surface.

Goldman et al., J. Appl. Phys., Vol. 60(4), pp. 1374–1376 (1986) proposed mounting the surface to be plated in vertical position and moving it continuously past a window in the side of a plating bath, with a seal surrounding the window in contact with the surface to be plated; smearing of the deposit tends to result from contact with the seal.

Bacon et al. U.S. Pat. No. 4,222,834 described plating the edge of an article by bringing it into contact with the surface of a plating bath so that the bath is drawn by surface tension into contact with both sides of the article as well as its edge.

Yamaguchi et al. U.S. Pat. No. 4,119,516 described continuous plating of the bottom of a strip by passing it over a plating bath while pumping the bath in turbulent flow against the lower face of the strip, and providing longitudinal seals in contact with the lateral margins of the strip.

In the present invention, the margins of the surface of the plating bath itself are defined by a horizontal rim or frame, and the liquid of the bath projects slightly above the edge of the rim, being held in place by the surface tension of the liquid. The surface of the article to be plated comes into contact only with the liquid of the bath, and not with the rim or frame of the container. No seal is provided, the extent of contact between the bath and the surface to be plated being limited by the surface tension of the liquid and by the rim which confines the liquid surface. Consequently, in one aspect, the invention comprises the method of plating with metal or alloy a surface of an article which comprises providing a liquid bath containing in solution said metal or alloy or a compound thereof, confining the lateral margins of the surface of said bath within horizontal rim or frame of solid material, said confined surface extending above said rim and being held therewithin solely by surface tension forces, bringing only the lower surface of the article to be plated into contact with the surface of said liquid bath, said article surface extending laterally beyond the margins of said liquid bath on every side, without bringing the article surface into contact with said frame, and maintaining said contact for a time sufficient for a plating deposit of the desired thickness to be built up on said article surface. In another aspect, the invention comprises apparatus for plating metal or metal alloy on the surface of an article which comprises a container for a liquid plating bath, said container having a horizontal upper rim serving to surround and confine the surface of said bath, means for introducing a supply of bath liquid into said container beneath said rim, means for withdrawing excess bath liquid from said container beneath said rim and means for maintaining said article with its lower surface extending laterally beyond and spaced above the rim of said container in position to be in contact with the surface of said bath when said container is full.

Figure 1:
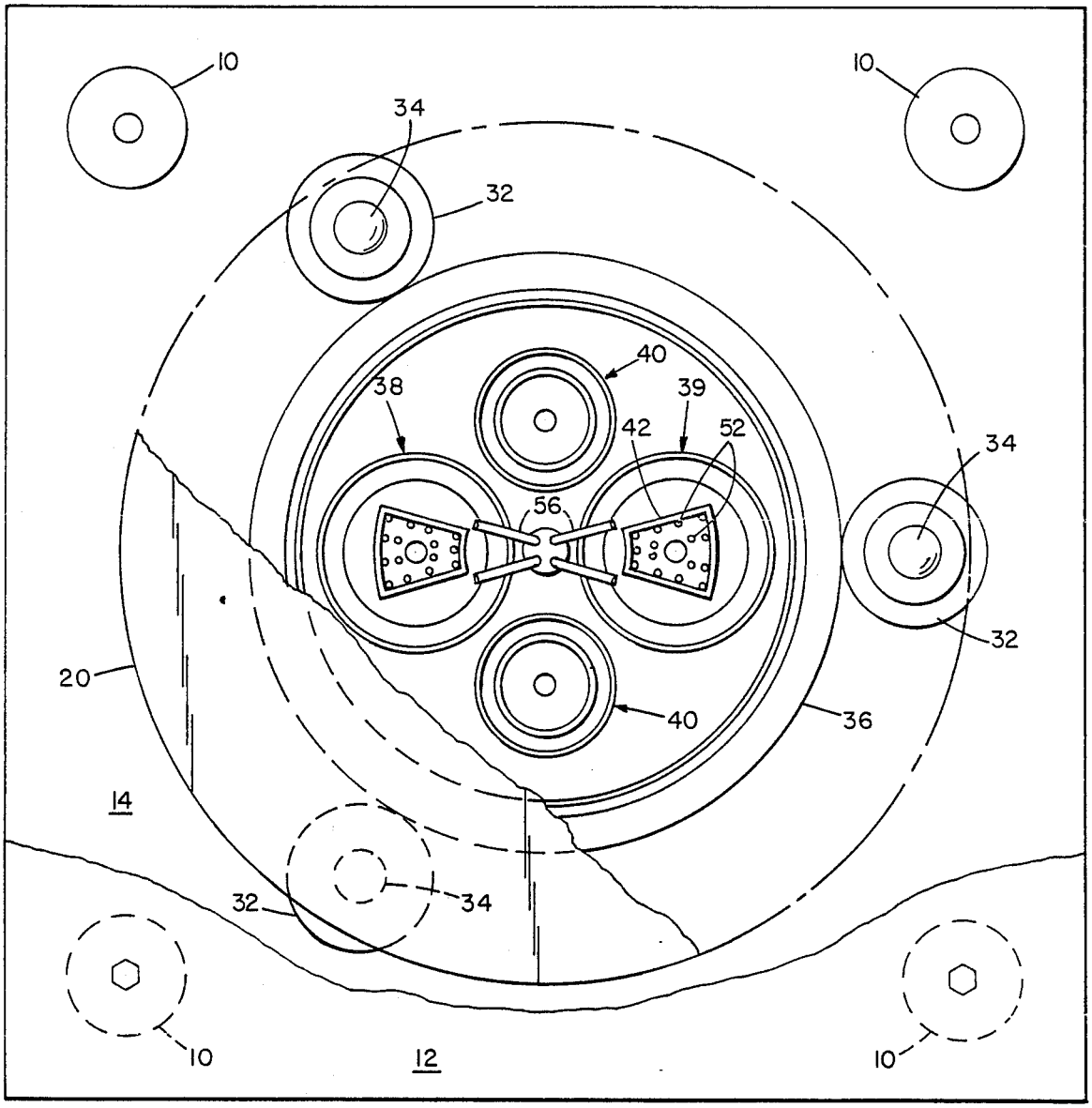
FIG. 1 is a plan view, partly broken away of one embodiment of the plating apparatus of the present invention.
Figure 2:
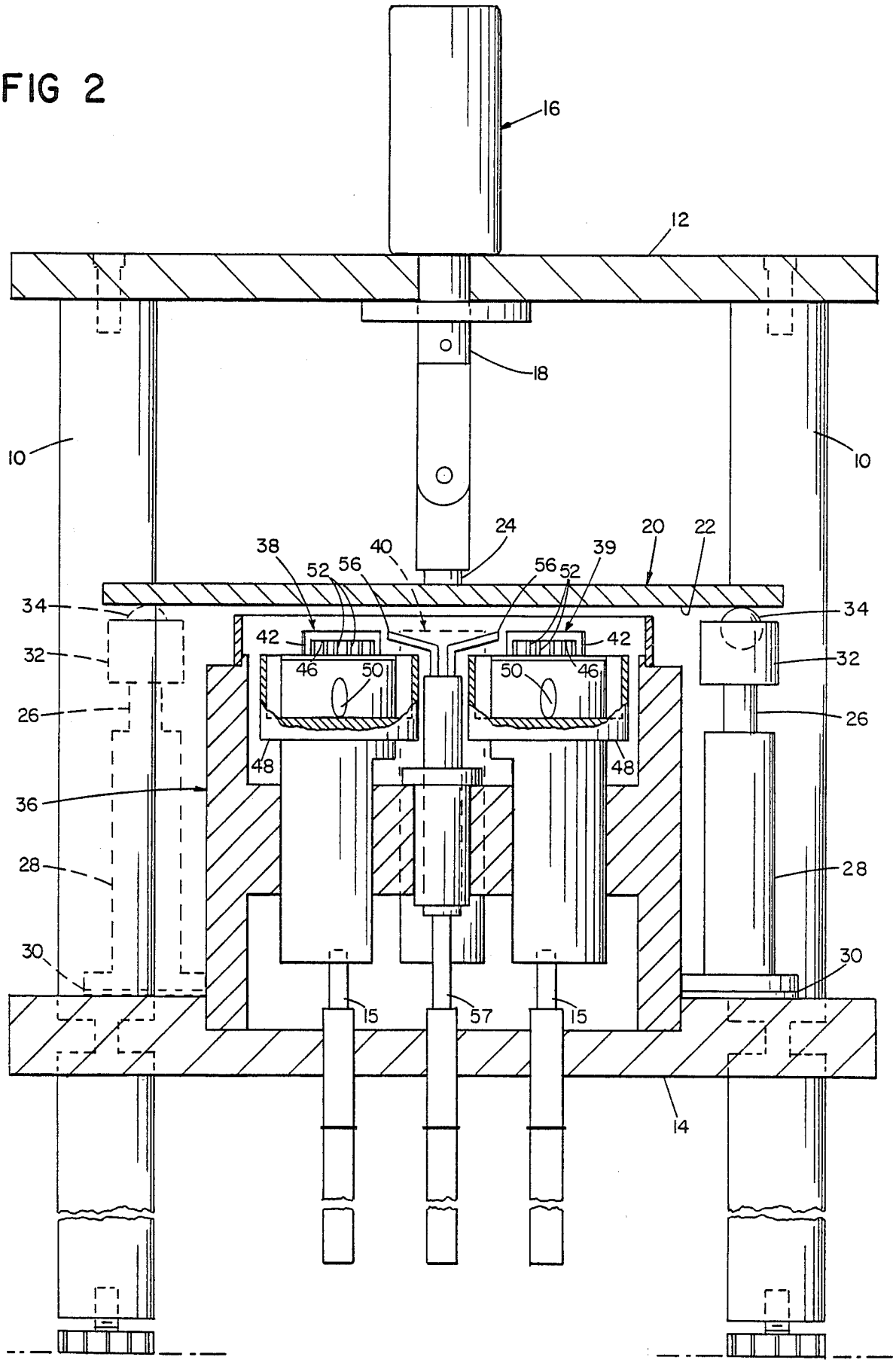
FIG. 2 is a view in vertical section of the embodiment of FIG. 1 prior to being placed in operation.

As shown in the drawings with particular reference to FIGS. 1 and 2, the plating apparatus comprises four supporting columns 10,10,10,10 on which are mounted top support member 12 and bottom support member 14. Top support member 12 carries electric motor 16 with downwardly extending drive shaft 18 to the bottom end of which is secured base metal disc 20, the lower surface 22 of which is to receive the desired plating. Disc 20 is secured to shaft 18 by a splined coupling 24 permitting limited vertical movement of disc 20 with respect to shaft 18. A plurality of disc support posts 26,26,26 carrying screw threads are mounted in threaded couplings 28,28 fixed to bottom support 14 with their lower knurled ends 30,30,30 projecting beneath bottom support 14 in position to be engaged by the fingers. Rotation of posts 26,26,26 advances or retracts them as the case may be in a vertical direction. Each post carries on its upper end a bearing plate 32 carrying on its upper surface ball bearings 34 mounted in a suitable raceway in position to contact and support the lower face 22 of disc 20 as it is rotated by shaft 18.

Figure 3:
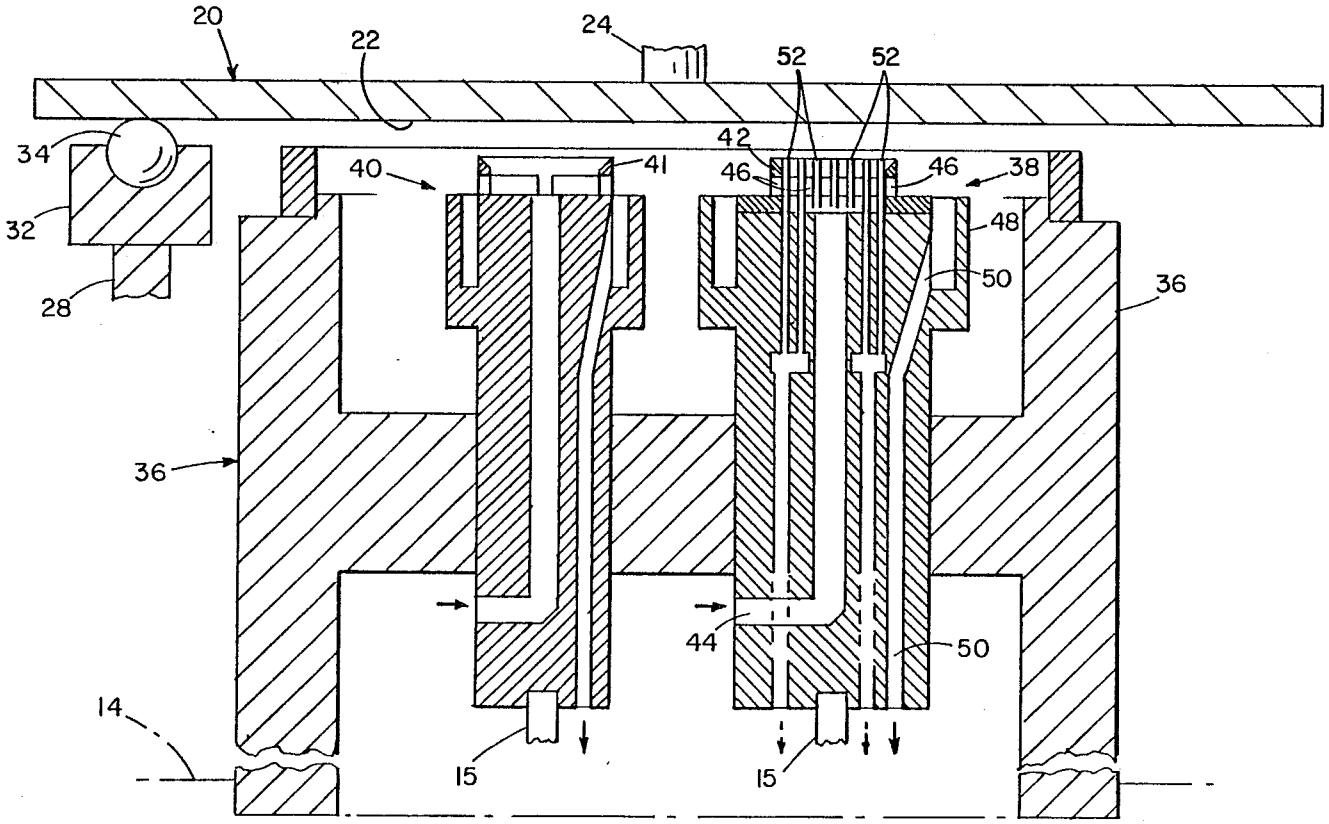
FIG. 3 is a view in section, partly broken away, showing the construction of the plating and washing units.

A liquid impervious cylindrical wall 36 is mounted upon and sealed to bottom support 14 forming therewith an enclosing clean chamber for two oppositely disposed plating units 38,39 and optional washing units 40,40. Each plating unit 38,39 as shown in FIG. 3, is mounted in fixed position on bottom support 14 by means of vertically adjustable pillars 15,15,15,15 and comprises a tubular member or container 42 open at the top and having a cross-sectional shape which is a sector of an annulus as appears in FIG. 1. Each tubular member 42 includes an inlet 44 (FIG. 3) near its bottom for admitting plating bath solution from a central supply and outlets 46,46 in its sidewall beneath its upper rim through which excess plating bath solution can flow into annular collecting trough 48 surrounding tubular member 42. Each trough is provided with one or more outlet passages 50 which returns plating bath solution to the central supply. Each plating bath unit also includes a plurality of small diameter suction tubes 52 mounted vertically within tubular member 42 and having their open ends or orifices lying beneath and adjacent to a plane passing through upper rim of tubular member 42. Inlet 44 and outlet 50 communicate with a central supply reservoir of plating bath liquid. Suction tubes 52,52 are connected to a suitable source of suction (not shown).

Each of washing units 40,40 is substantially identical in construction to plating units 38,39 except that suction tubes 52,52 are omitted, upper rim 41 is circular, and the inlet and outlet of the unit are connected to a suitable reservoir of wash liquid or water (not shown).

Also provided are gas jets 56,56 disposed outside of and adjacent the upper margins of container 42 and supported from lower support member 14 by vertically adjustable pillar 57. The gas jets are connected to a source (not shown) of a suitable inert gas such as argon.

When the apparatus is to be used for electroplating, a suitable source of electrical potential is connected between the interior of the tubular members 42 of the plating units which contain the liquid electroplating bath, and the electrically conductive surface 22 of the article to be plated. In the case of electroless plating or liquid phase epitaxy, no such electric potential is needed.

Figure 4:
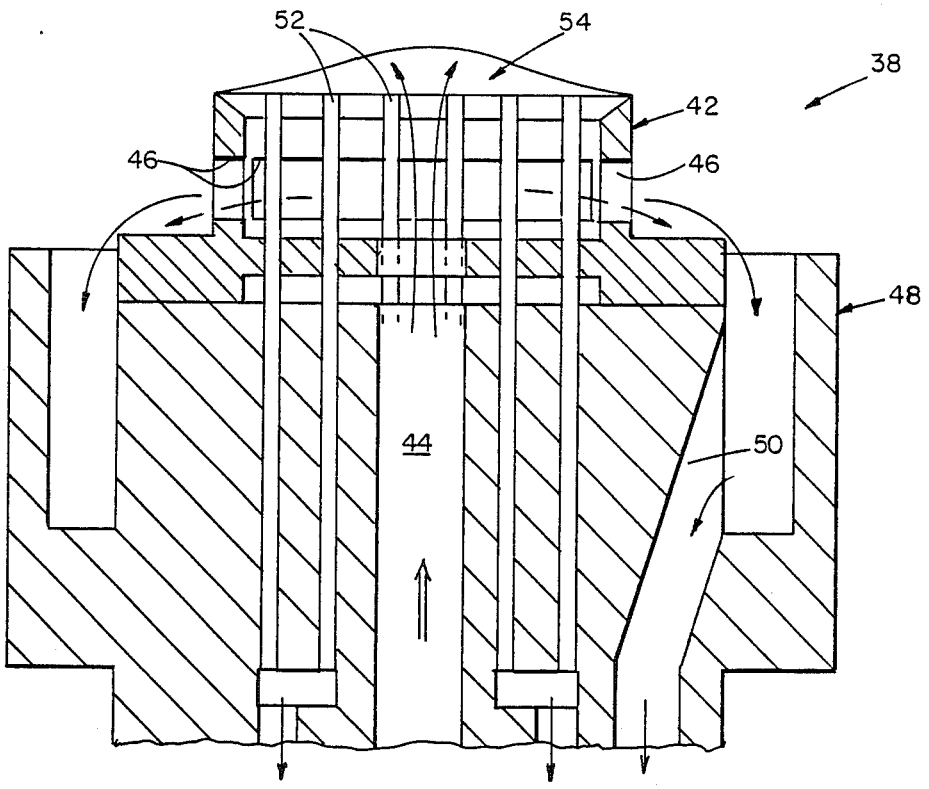
FIG. 4 is a view in section on an enlarged scale of a plating unit showing formation of the surface of the plating bath prior to the plating operation.
Figure 5:
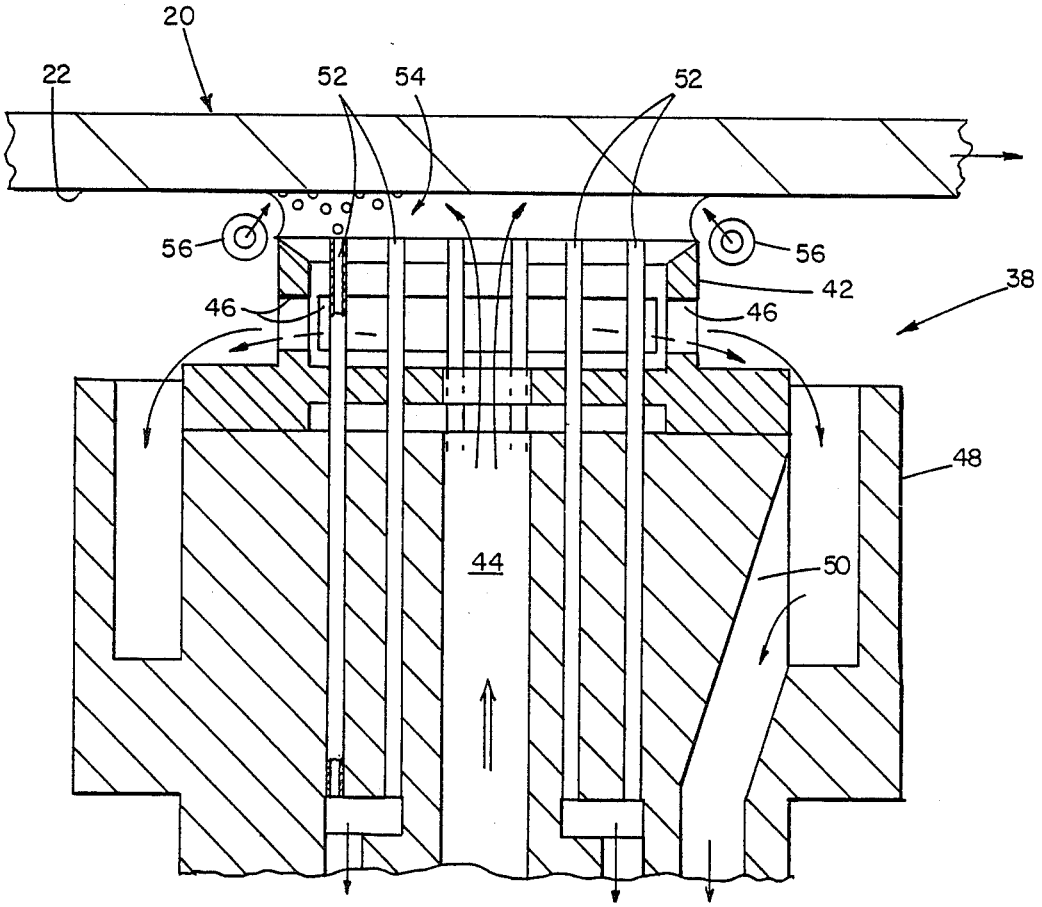
FIG. 5 is a view corresponding in part to FIG. 4 showing the plating unit in operation.

In operation of the device, a supply of the appropriate liquid plating bath or solution is continuously pumped into each plating unit 42 so that, as shown in FIG. 4, the surface of the bath forms a meniscus raised above the upper horizontal rim of tubular member 42, the rim serving to confine the lateral margins of the surface of the bath, which are held in position solely by surface tension forces. The rates of flow through the inlet 44 and outlets 50,50 are adjusted so as to maintain the meniscus in approximately the form shown in FIG. 4. The article to be plated, which in the embodiment shown is metal disc 20, is mounted on drive shaft 18 and the vertical positions of disc support posts 26,26 are adjusted manually so that the lower surface 22 of disc 20 comes into contact with the projecting surface 54 of the plating bath as shown in FIG. 5, the area of contact being well-defined by surface tension forces in the liquid and by the upper margin or rim of tubular member 42. The vertical positions of plating units 38,39, of washing units 40,40, and of jets 56 may also be adjusted vertically if necessary. Surface 22 remains spaced apart from the upper rim of tubular member 42 as well as from the upper ends of suction tubes 52,52, and from the upper rim or margin 41 of wash units 40,40 so that the lower surface 22 comes into contact only with the liquid plating bath 54 and with the wash liquid in units 40,40. Disc 20 is then rotated slowly by means of shaft 18 so that a given portion of the surface 22 comes into position successively above a plating unit and a wash unit. If bubbles of hydrogen appear in the plating bath near the surface 22, as happens in the case of certain aqueous electroplating baths and/or certain metal surfaces, suction is applied to suction tubes 52,52 to remove the bubbles as rapidly as possible. Although the volume of liquid which is removed through suction tubes 52,52 along with the gas bubbles is relatively very small, nevertheless some adjustment of the inlet and outlet rates of flow of plating bath through the plating unit may be required in order to provide the desired balance and maintain the surface of liquid bath 54 above the level of the upper margin of tubular member 42 and in contact with the lower surface 22 of disc 20. Because surface 22 does not come into contact with any other solid surface, no smearing or other distortion of the plating deposit occurs. If desired, plating baths of two different compositions may be employed in plating units 38,39 respectively, thus making it possible to apply successively different plating deposits on the surface as the disc 20 rotates.

In the event that some dragging or distortion of the margin of bath 54 is caused by the lateral advancing movement of disc 20, indicated by the arrow in FIG. 5, it may be desirable to activate gas jets 56,56 so as to provide a jet of air or of an inert gas such as argon from nozzles 56,56 against the juncture of surface 22 and the surface of liquid bath 54 to supplement the surface tension forces and stabilize the margin.

Any liquid plating bath of conventional composition for electroplating or for electroless plating may be employed in the present invention, and if desired heating or cooling units may be provided in the reservoir or in the plating units themselves to maintain the bath at the desired temperature.

While in the embodiment shown the plating deposit is in the form of an annulus because of the rotational movement of the surface being plated, it will be understood that the invention applies equally well when the surface to be plated is stationary or moves in a straight line laterally across the rim confining the surface of the bath.

What is claimed is:

1. Method of plating with metal or alloy a surface of an article which comprises providing a liquid bath containing in solution said metal or alloy or a compound thereof, continuously supplying fresh solution within said liquid bath and continuously withdrawing solution from beneath the surface of said bath, confining the lateral margins of the surface of said bath within a horizontal rim of solid material, said confined surface extending above said rim and being held therewithin solely by surface tension forces, bringing only the lower surface of the article to be plated into contact with the surface of said liquid bath without bringing the article surface into contact with said rim, said article surface extending laterally beyond the margins of said liquid bath on every side, and maintaining said contact for a time sufficient for a plating deposit of the desired thickness to be built up on said article surface.

2. Method as claimed in claim 1 in which said surface to be plated is electro-conductive, said method comprising in addition the step of maintaining an electric potential between said article to be plated and said liquid bath.

3. Method as claimed in claim 1 comprising in addition the step of advancing said article surface laterally across said bath while maintaining contact between the article surface and the surface of said bath.

4. Method as claimed in claim 1 in which said bath comprises an aqueous solution, said method comprising in addition the steps of maintaining an electrical potential between said bath and the surface of the article to be plated, and continuously withdrawing gas bubbles from beneath and adjacent to the surface of said bath.

5. Method as claimed in claim 1 comprising in addition the step of advancing said article surface laterally across said bath while maintaining contact between the article surface and the surface of said bath.

6. Method as claimed in claim 3 comprising in addition the step of blowing a stream of gas externally of said bath laterally against the juncture of said article surface and said liquid bath surface.

7. Method as claimed in claim 1 in which said bath comprises an aqueous solution, said method comprising in addition the steps of advancing said article surface laterally across said bath while maintaining contact between the article surface and the surface of said bath and maintaining an electrical potential between said bath and the surface of the article to be plated.

8. Method as claimed in claim 7 comprising in addition the step of blowing a stream of gas externally of said bath laterally against the juncture of said article surface and said liquid bath surface.

9. Apparatus for plating metal or metal alloy on the surface of an article which comprises a container for a liquid plating bath, said container having a horizontal upper rim serving to surround and confine the surface of said bath, means for introducing a supply of bath liquid into said container beneath said rim, means for withdrawing excess bath liquid from said container beneath said rim, and means for maintaining said article with its lower suface extending laterally beyond and spaced above the rim of said container in position to be in contact with the surface of said bath when said container is full.

10. Apparatus as claimed in claim 9 comprising in addition suction means for withdrawing gas bubbles from said bath, said suction means having at least one orifice positioned to lie beneath and adjacent to a plane passing through the upper rim of said container.

11. Apparatus as claimed in claim 9 comprising in addition means for advancing said article surface across the surface of said bath, and means outside said container for blowing gas against the juncture between said article surface and said bath surface adjacent the rim of said container.

12. Apparatus as claimed in claim 11 comprising in addition means for maintaining an electric potential between said article and said bath.

* * * * *